US009622631B2

(12) United States Patent
Cipolla

(10) Patent No.: US 9,622,631 B2
(45) Date of Patent: Apr. 18, 2017

(54) SURFACE CLEANING NOZZLE ADJUSTMENT APPARATUS WITH ADJUSTABLE BLADE ASSEMBLY

(71) Applicant: Techtronic Floor Care Technology Limited, Tortola (VG)

(72) Inventor: Mark E. Cipolla, Chardon, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 649 days.

(21) Appl. No.: 14/030,851

(22) Filed: Sep. 18, 2013

(65) Prior Publication Data

US 2015/0074939 A1 Mar. 19, 2015

(51) Int. Cl.

| | |
|---|---|
| ***A47L 9/04*** | (2006.01) |
| ***A47L 9/06*** | (2006.01) |
| ***A47L 5/34*** | (2006.01) |
| ***A47L 5/30*** | (2006.01) |
| *A47L 5/26* | (2006.01) |

(52) U.S. Cl.

CPC ..... *A47L 9/0653* (2013.01); *A47L 5/30* (2013.01); *A47L 5/34* (2013.01); *A47L 5/26* (2013.01); *A47L 9/066* (2013.01)

(58) Field of Classification Search

CPC .... A47L 11/18; A47L 11/282; A47L 11/4041; A47L 11/4044; A47L 11/4058; A47L 13/11; A47L 5/10; A47L 5/26; A47L 5/30; A47L 5/34; A47L 9/066; A47L 9/0653; A47L 9/0494; A47L 9/0477; A47L 9/04

USPC ..... 15/48, 97.1, 98, 362, 363, 383

See application file for complete search history.

(56) References Cited

U.S. PATENT DOCUMENTS

| | | | | |
|---|---|---|---|---|
| 2,225,432 A * | 12/1940 | Ginsberg | ..... | A47L 1/06 15/145 |
| 2,440,099 A * | 4/1948 | Kind | ..... | A47L 1/06 15/146 |
| 2,682,682 A * | 7/1954 | Lewyt | ..... | A47L 9/06 15/325 |
| 2,689,369 A | 9/1954 | Biek | | |

(Continued)

FOREIGN PATENT DOCUMENTS

| | | |
|---|---|---|
| WO | WO 9829020 | 7/1998 |
| WO | WO 2011020036 | 2/2011 |

OTHER PUBLICATIONS

Bissell, Lift-Off Revolution User's Guide 3760/4220/6850/6860 Series (2005) 16 pages.

(Continued)

*Primary Examiner* — Joseph J Hail
*Assistant Examiner* — Arman Milanian
(74) *Attorney, Agent, or Firm* — Michael Best & Friedrich LLP

(57) ABSTRACT

A surface cleaner including a housing and a blade assembly with a blade element. The blade assembly is movable between a lowered position and a raised position relative to the housing. A spring is coupled between the housing and the blade assembly, and the spring applies a force on the blade assembly to move the blade assembly toward the lowered position. The blade element is allowed to move toward the raised position, against the force, such that the force maintains the blade element in contact with a surface to be cleaned. In addition, when in the raised position, the blade element is held against the force and inhibited from moving toward the lowered position.

17 Claims, 6 Drawing Sheets

(56) References Cited

U.S. PATENT DOCUMENTS 3,137,884 A * 6/1964 Meyerhoefer ..... A47L 9/06 15/339
3,262,147 A * 7/1966 Waters ..... A47L 5/34 15/354
3,683,448 A * 8/1972 Lagerstrom ..... A47L 5/34 15/354
3,721,502 A * 3/1973 Ognibene ..... A47L 1/08 15/119.2
3,727,263 A * 4/1973 Johansson ..... A47L 9/0653 15/373
3,735,443 A 5/1973 Deutscher et al.
3,821,831 A * 7/1974 Grover ..... A47L 9/0653 15/339
3,822,436 A 7/1974 Burgoon
4,083,079 A 4/1978 Vermillion
4,167,801 A * 9/1979 Erbor ..... A47L 9/0494 15/354
4,446,594 A * 5/1984 Watanabe ..... A47L 5/34 15/323
4,467,495 A * 8/1984 Fish ..... A47L 9/0494 15/354
4,513,472 A 4/1985 Wells
4,823,430 A * 4/1989 Yonkers ..... A47L 5/34 15/361
4,926,515 A * 5/1990 Lynn ..... A47L 13/11 15/257.3
5,042,109 A * 8/1991 Stephens ..... A47L 5/34 15/333
5,081,734 A 1/1992 Sanford et al.
5,123,141 A 6/1992 Erickson et al.
5,222,276 A * 6/1993 Glenn, III ..... A47L 5/34 15/333
5,253,388 A 10/1993 Bacconnier
5,269,042 A * 12/1993 Stephens ..... A47L 5/34 15/333
5,349,716 A 9/1994 Millar
5,454,138 A 10/1995 Mondigo et al.
5,475,893 A * 12/1995 Sepke ..... A47L 9/066 15/364
5,539,953 A 7/1996 Kurz
5,551,120 A 9/1996 Cipolla et al.
5,553,349 A 9/1996 Kilström et al.
5,819,352 A 10/1998 Bancroft et al.
5,862,562 A 1/1999 Erken
5,906,024 A 5/1999 Jailor et al.
5,924,167 A 7/1999 Wright et al.
5,970,576 A * 10/1999 Maurer ..... A47L 5/34 15/339
5,974,625 A * 11/1999 Garner ..... A47L 5/28 15/333
5,983,448 A 11/1999 Wright et al.
5,991,972 A * 11/1999 Krebs ..... A47L 9/0494 15/354
6,000,088 A 12/1999 Wright et al.
6,065,182 A 5/2000 Wright et al.
6,076,230 A 6/2000 Harsh
6,081,963 A 7/2000 Jailor et al.
6,101,671 A 8/2000 Wright et al.
6,170,119 B1 * 1/2001 Conrad ..... A47L 5/22 15/339
6,357,076 B1 * 3/2002 Lee ..... A47L 9/0494 15/354
6,385,811 B1 5/2002 Dilger et al.
6,804,853 B2 10/2004 Wang
6,931,690 B2 8/2005 Cox
6,973,698 B1 12/2005 Kotlarski
7,000,282 B2 2/2006 Cox et al.
7,213,298 B2 5/2007 Cipolla et al.
7,222,390 B2 5/2007 Cipolla et al.
7,246,407 B2 * 7/2007 Park ..... A47L 5/34 15/354
7,251,856 B2 8/2007 Kaffenberger et al.
7,353,563 B2 * 4/2008 Blocker ..... A47L 5/34 15/356
7,594,294 B2 9/2009 Billig et al.
8,001,646 B2 8/2011 Blom
2004/0134019 A1 * 7/2004 Cipolla ..... A47L 5/28 15/340.2
2004/0211027 A1 10/2004 Park et al.
2005/0210625 A1 9/2005 Joung et al.
2007/0209147 A1 * 9/2007 Krebs ..... A47L 5/30 15/347
2007/0220701 A1 9/2007 Kwon et al.
2007/0234505 A1 10/2007 Gordon et al.
2008/0086838 A1 * 4/2008 Yoo ..... A47L 9/04 15/415.1
2008/0120801 A1 * 5/2008 Kim ..... A47L 9/0666 15/383
2008/0271285 A1 * 11/2008 Maurer ..... A47L 5/30 15/389
2008/0289141 A1 * 11/2008 Oh ..... A47L 9/04 15/354
2009/0056069 A1 * 3/2009 Miner ..... A47L 5/225 15/415.1
2011/0035899 A1 * 2/2011 Charlton ..... A47L 5/34 15/347
2011/0167583 A1 7/2011 Weaver et al.

OTHER PUBLICATIONS

Bissell, PowerClean Upright Vacuum Model 35401 User's Guide (1998) 13 pages.
Bissell, CleanView Bagless User's Guide 3590/3591/8990 Series (2004) 14 pages.
Bissell, CleanView Bagless User's guide 3593/3594/6590 Series (2004) 16 pages.
International Search Report and Written Opinion for Application No. PCT/US2010/045494 dated Oct. 26, 2010 (14 pages).
International Preliminary Report on Patentability for Application No. PCT/US2010/045494 dated Feb. 14, 2012 (8 pages).
Co-pending U.S. Appl. No. 12/856,332, filed Aug. 13, 2010.

* cited by examiner

SURFACE CLEANING NOZZLE ADJUSTMENT APPARATUS WITH ADJUSTABLE BLADE ASSEMBLY

BACKGROUND

The present invention relates to a surface cleaning nozzle for surface cleaners.

SUMMARY

In one embodiment, the invention provides a surface cleaner including a housing and a blade assembly with a blade element. The blade assembly is movable between a lowered position and a raised position relative to the housing. A spring is coupled between the housing and the blade assembly, and the spring applies a force on the blade assembly to move the blade assembly toward the lowered position. The blade assembly is allowed to move toward the raised position, against the force, such that the force maintains the blade element in contact with a surface to be cleaned. In addition, when in the raised position, the blade assembly is held against the force and inhibited from moving toward the lowered position.

In another embodiment the invention provides a surface cleaner including a housing and a blade assembly with a blade element. The blade assembly is movable between a lowered position and a raised position relative to the housing. A spring is coupled between the housing and the blade assembly, and the spring applies a force on the blade assembly to move the blade assembly toward the lowered position. An adjustment member is coupled to the blade assembly, and actuation of the adjustment member moves the blade assembly from the lowered position to the raised position.

In another embodiment the invention provides a surface cleaner including a housing and an adjustable lift assembly coupled to and moveable relative to the housing. The surface cleaning nozzle also includes an adjustable blade assembly coupled to and moveable relative to the housing. An adjustment member is coupled to and moveable relative to the housing to adjust the adjustable lift assembly and the adjustable blade assembly.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
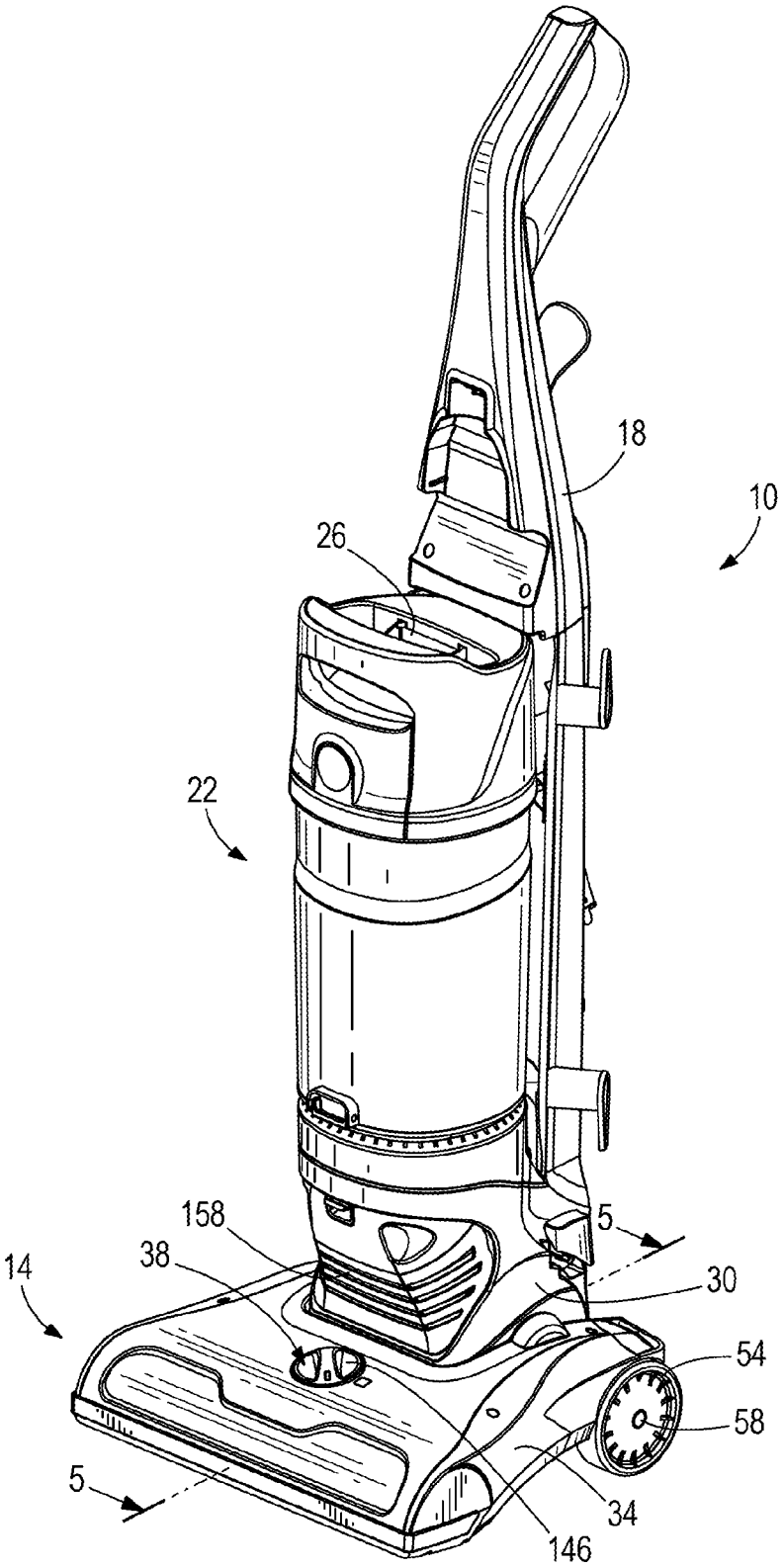
FIG. 1 is a perspective view of a vacuum cleaner according to one embodiment of the invention.

FIG. 1 illustrates a vacuum cleaner 10. The illustrated vacuum cleaner 10 includes a foot or base 14 and a handle assembly 18 that is pivotally coupled to the base 14 such that in the illustrated embodiment, the vacuum cleaner 10 is an upright vacuum cleaner. In other embodiments, the invention could also be used with other surface cleaners such as a canister vacuum cleaner, a stick-type vacuum cleaner, a hand-held vacuum cleaner, an accessory tool, a steam mop, a hard floor cleaner, a wet extractor, or the like. The vacuum cleaner 10 further includes a dirt separation unit 22 that is removably coupled to the handle assembly 18 via a latch 26. In the illustrated embodiment, the dirt separation unit 22 includes a cyclonic separator (not shown) and a dirt collection chamber (not shown) located below the separator to collect dirt and debris separated by the separator. In other embodiments, the dirt separation unit 22 can include multiple cyclonic stages or include vacuum bags, filters, and the like. A suction source (for example, an impeller driven by an electric motor, not shown) is disposed within a motor housing 30 at the bottom portion of the handle assembly 18. The suction source is operable to generate an airflow through the dirt separation unit 22.

Figure 2:
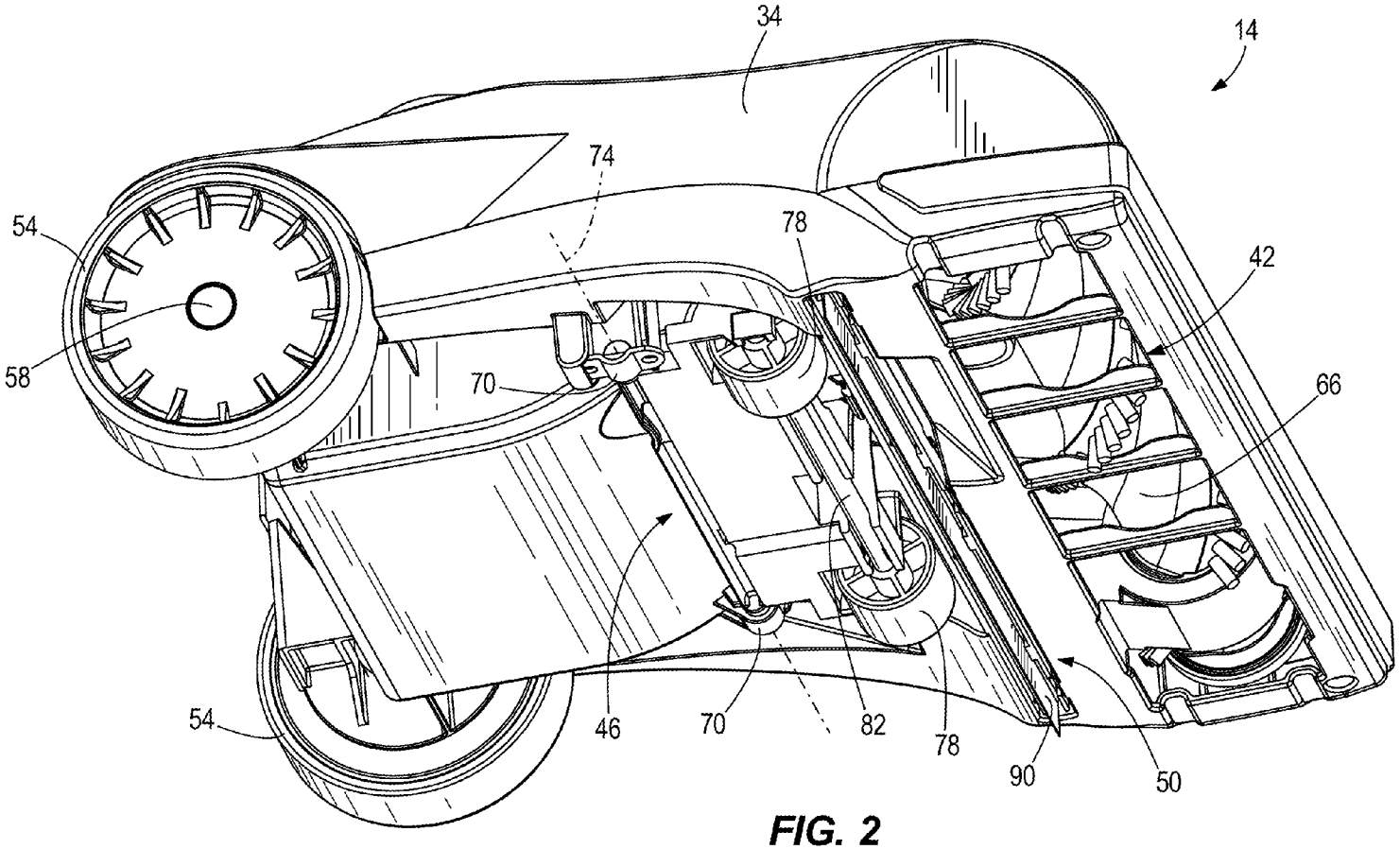
FIG. 2 is a bottom perspective view of a base of the vacuum cleaner of FIG. 1 including an adjustable lift assembly and an adjustable blade assembly.
Figure 5:
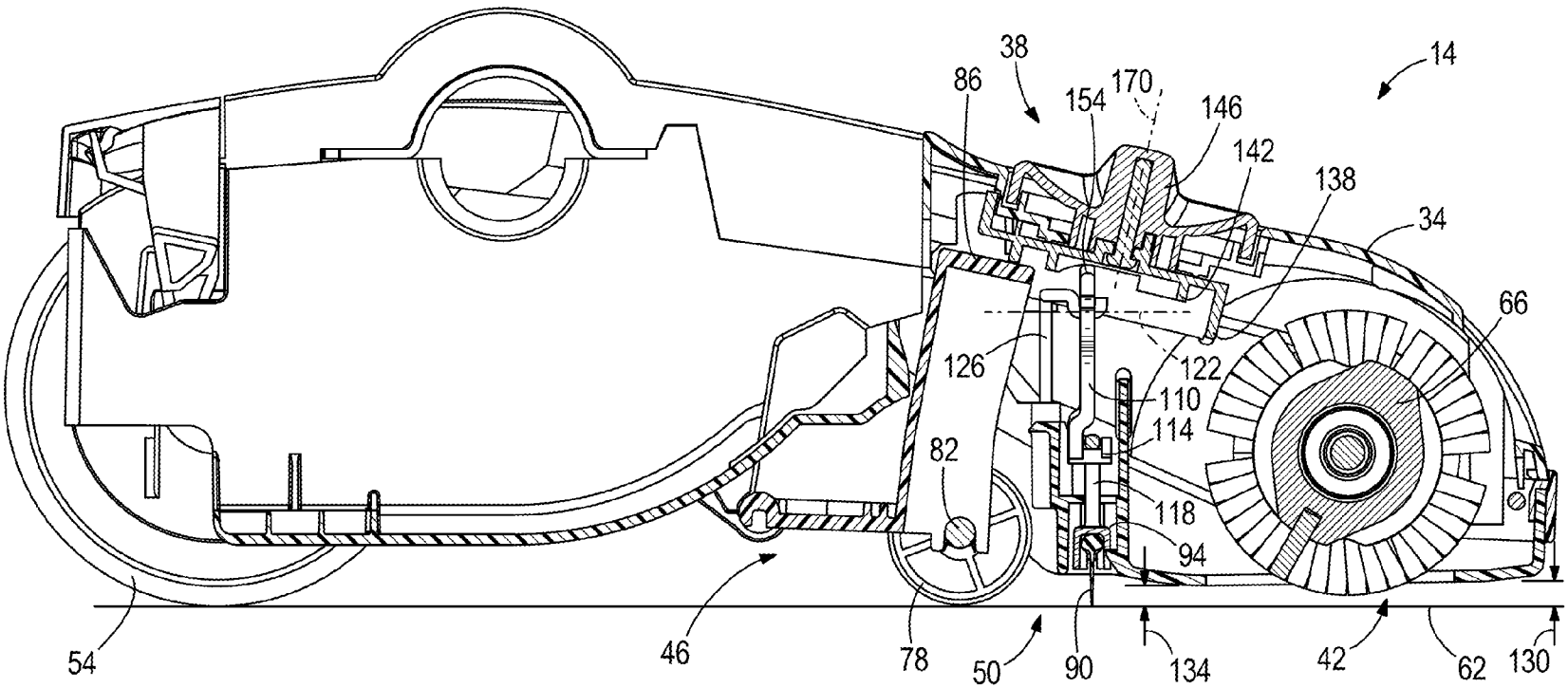
FIG. 5 is a cross-sectional view taken along line 5-5 of FIG. 1 with the adjustable lift assembly in a first position and the adjustable blade assembly in a lowered position.
Figure 6:
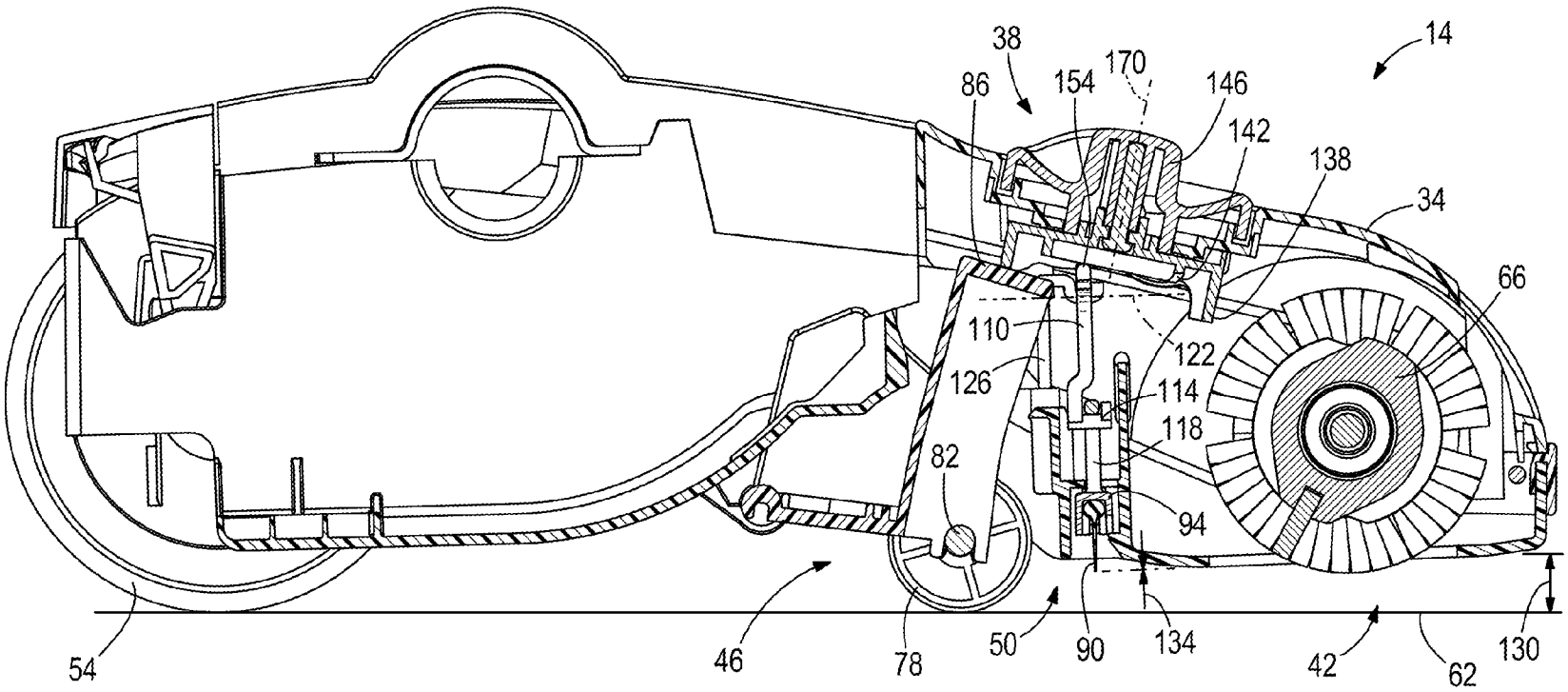
FIG. 6 is a cross-sectional view taken along line 5-5 of FIG. 1 with the adjustable lift assembly in a second position and the adjustable blade assembly in a raised position.

Referring to FIGS. 1 and 2, the base 14 includes a housing 34, an adjustment member 38, a nozzle inlet 42, an adjustable lift assembly 46, and an adjustable blade assembly 50. The housing 34 forms a cover over the nozzle inlet 42 and provides an attachment point for additional components of the base 14. The base 14 also includes wheels 54 rotatably coupled to the housing 34 via pins 58. The wheels 54 support the base 14 for movement on a surface 62 to be cleaned by the vacuum cleaner 10 (FIGS. 5-6). Referring to FIG. 2, an agitator brush or brush roll 66 is rotatably mounted in the housing 34 and can be driven by, for example, the motor via a belt (not shown).

Figure 3:
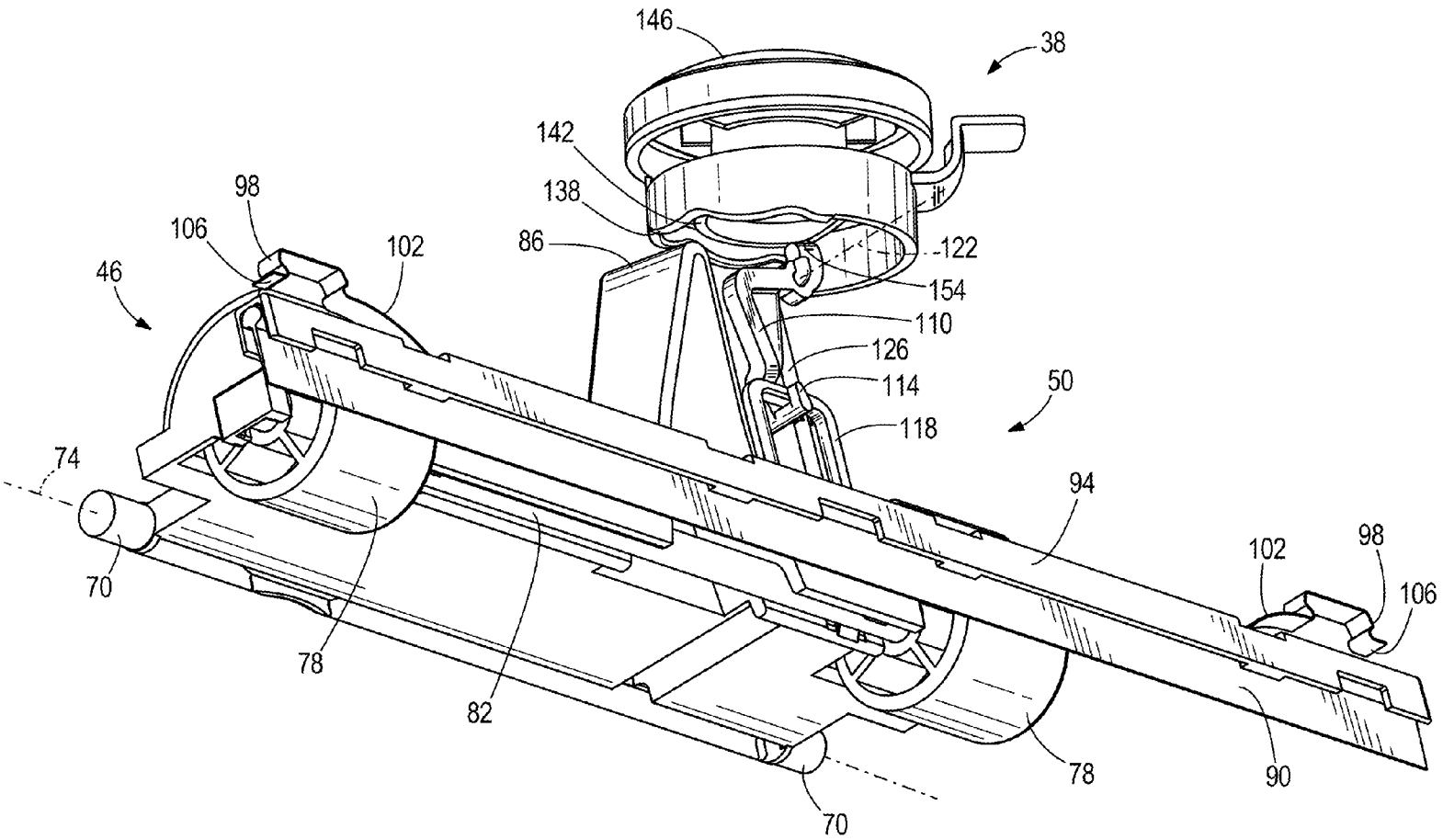
FIG. 3 is a perspective view of the adjustable lift assembly and the adjustable blade assembly with an adjustment member of the vacuum cleaner of FIG. 1.

Referring to FIGS. 2-3, the adjustable lift assembly 46 is pivotally coupled to the housing 34 via connection portions 70 such that the lift assembly 46 pivots with respect to the housing 34 about an axis 74. As will be discussed in more detail below, the lift assembly 46 pivots about the axis 74 to adjust the height of the nozzle inlet 42 with respect to the surface 62. Wheels 78 are rotatably mounted on an axle 82 to the lift assembly 46 to support the lift assembly 46 and the base 14 for movement on the surface 62. The lift assembly 46 is movable between a first position (FIG. 5) and a second position (FIG. 6). In the embodiment shown, the lift assembly 46 includes a projection 86 coupled to the adjustment member 38. The weight of the base 14 forces the adjustment member 38 onto the projection 86 such that the adjustment member 38 is forced by gravity into contact with the projection 86.

With continued reference to FIGS. 2-3, the adjustable blade assembly 50 includes a wiper blade element 90 coupled to a bracket 94, and is movable between a lowered position (FIG. 5) and a raised position (FIG. 6) relative to the housing 34. A spring 98 is coupled between the housing 34 and each opposite end of the blade assembly 50 to apply a force on the blade assembly 50 to move the blade assembly 50 toward the lowered position. In one example, each spring 98 is formed as a leaf spring fixedly connected to the housing 34 at its first end 106 and slidably in contact with the blade assembly 50 at its other end 102 thereby providing a downward spring force to the blade assembly 50. In other embodiments, springs other than a leaf spring could be used such as compression springs, extension springs, torsion springs, fluid, hydraulic, or pneumatic springs and the like.

When in the lowered position, the blade element 90 is allowed to move toward the raised position, against the force of the springs 98 when the surface to be cleaned 62 contacts the blade element 90 (i.e., the blade element "floats" over uneven surfaces). The force maintains the blade element 90 in contact with the surface to be cleaned 62. When in the raised position, the blade element 90 is held against the force and inhibited from moving toward the lowered position, as will be described in detail below. In the embodiment shown in FIG. 3, the blade assembly 50 further includes an arm member 110 to couple the blade element 90 and the bracket 94 to the adjustment member 38. The arm member 110 includes a hook 114 to connect to a loop portion 118 formed on the bracket 94. In one example, the arm member 110 rotates about an axis 122 on a housing support 126 to move the blade assembly 50 between the lowered and raised positions.

Figure 4:
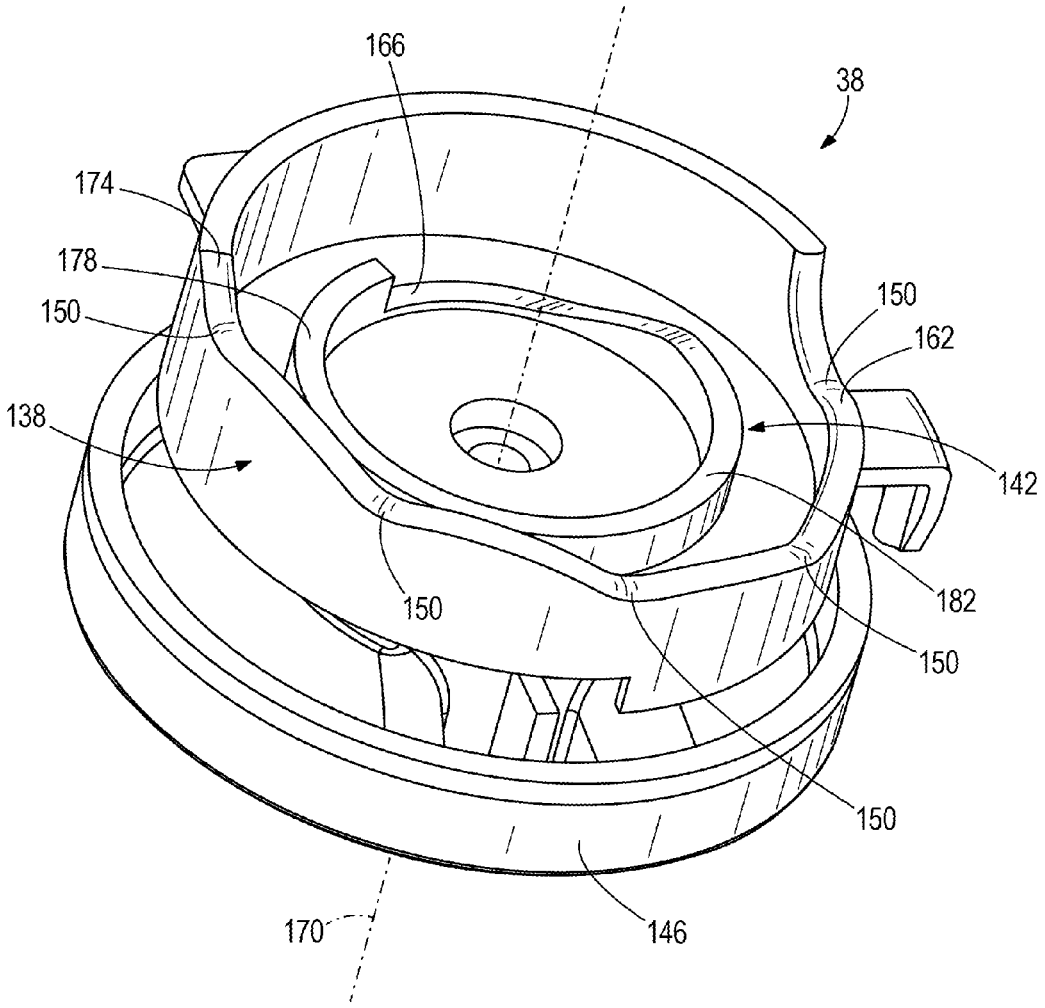
FIG. 4 is a perspective view of the adjustment member of FIG. 3.

Referring to FIGS. 3-5, the adjustment member 38 is operable by the user to adjust both the adjustable lift assembly 46 and the adjustable blade assembly 50. The adjustment member 38 adjusts the nozzle inlet 42 a distance 130 above the surface 62 (i.e., moves the housing 34 with respect to the surface 62), and adjusts the blade element 90 a distance 134 extending from the housing 34 (i.e., moves the blade element 90 with respect to the housing 34). The adjustment member 38 includes a first outside ramp 138 and a second inside ramp 142, both on the underside of a rotatable knob 146. Although the measured distances 130, 134 are measured from the bottom of the housing 34, the relative distances could also be measured from a consistent point located at a higher position on the housing 34. For example, the distances could be measured from the pivot axis 122 of the arm member 110 of the blade assembly 50 (i.e., where the arm member 110 is pivotally attached to the housing 34).

With continued reference to FIGS. 3 and 4, the projection 86 of the lift assembly 46 slides or moves along the outside ramp 138. The outside ramp 138 includes a plurality of cam surfaces 150 or undulations that are representative of discrete distances 130 of the nozzle inlet 42 from the surface 62 (i.e., the housing 34 at different heights off the surface 62). The various distances correspond to effective nozzle heights for cleaning floors of various heights (e.g., high pile carpet, low pile carpet, hard floors, etc.). Likewise, the arm member 110 of the blade assembly 50 includes a cam surface 154 that slides or moves along the inside ramp 142. The cam surface 154 is forced into engagement with the inside ramp 142 by the springs 98 (i.e., the springs 98 apply a downward force on the bracket 94, which forces the arm member 110 counter-clockwise into engagement with the inside ramp 142 (as viewed from the front of the base 14)).

In operation, the suction source of the vacuum cleaner 10 generates a suction or airflow that travels into the vacuum cleaner 10 through the nozzle inlet 42 to remove dirt and debris from the surface 62. The air and debris travels into the dirt separation unit 22 where the debris and air are separated. The debris is collected in the dirt separation unit 22 while relatively clean and filtered air is exhausted out of the dirt separation unit 22 and toward the suction source. After passing through the suction source, the working air is then exhausted through an outlet or exhaust opening 158.

Referring to FIGS. 5 and 6, depending on the application of the vacuum cleaner 10, including the type of surface 62 to be cleaned, the user may desire to change the distance 130 that the nozzle inlet 42, and therefore the brushroll 66 in the illustrated embodiment is positioned above the surface 62. In addition, the user may desire to change the distance 134 that the blade element 90 is extended from the housing 34. For example, for a carpeted surface, the user may adjust the nozzle inlet 42 relative to the surface 62 with the blade element 90 retracted into the housing 34. Alternatively, for a bare surface, the user may position the nozzle inlet 42 with the blade element 90 extended from the housing 34. The user adjusts the distances 130,134, for example, by rotating the adjustment member 38. The illustrated embodiment adjusts both the nozzle inlet 42 height and the blade element 90 position simultaneously with a single adjustment member 38. However, in other embodiments, the nozzle inlet 42 height and the blade element 90 position could be adjusted independently by a common adjustment member or by separate adjustment members.

When the lift assembly 46 is positioned in the first position (FIG. 5), the user can raise the nozzle inlet 42, and therefore the brush roll 66, by moving the lift assembly 46 to the second position (FIG. 6). The outside ramp 138 also allows the user to select discrete positions for the lift assembly 46 in addition to the first and second positions. In the first position (FIG. 5), the projection 86 of the lift assembly 46 is at a first end 162 of the outside ramp 138, and the cam surface 154 on the arm member 110 of the blade assembly 50 is at a first end 166 of the inside ramp 142 (FIG. 4). With the cam surface 154 at the first end 166 of the inside ramp 142, the springs 98 are able to force the blade element 90 into the lowered position (FIG. 5).

To move the nozzle inlet 42 and to retract the blade element 90, the user rotates the knob 146 in a first direction about an axis 170 with respect to the housing 34. Rotating the knob 146 rotates the outside ramp 138 and the inside ramp 142 with respect to the housing 34. Rotating the knob 146 in the first direction cause the projection 86 to move or slide along the outside ramp 138 from the first end 162 toward a second end 174, and the cam surface 154 to move or slide along the inside ramp 142 from the first end 166 toward a second end 178. As the projection 86 moves along the outside ramp 138 from the first end 162 toward the second end 174, the lift assembly 46 is forced to pivot about the axis 74 with respect to the housing 34. Movement of the lift assembly 46 causes the housing 34 to move with respect to the surface 62, raising or lowering the nozzle inlet 42 and the distance 130. As the projection 86 is translating along the outside ramp 138, the cam surface 154 is also translating along the inside ramp 142. As the cam surface 154 moves along the inside ramp 142 from the first end 166 toward the second end 178, the arm member 110 is rotated about the axis 122, raising the bracket 94 and the blade element 90 to the raised position.

The inside ramp 142 includes a flat portion 182 toward the second end 178 that does not cause any adjustment of the blade assembly 50 as the knob 146 continues to rotate and after the blade assembly 50 has been moved to the raised position. This enables the user to keep the blade element 90 in the raised position in all nozzle inlet 42 positions except for when the lift assembly 46 is in the first position (i.e., bare floor cleaning). The user can continue to rotate the knob 146 until the projection 86 reaches the second end 174 of the outside ramp 138, at which point the lift assembly 46 is in the second position, and the blade assembly 50 is in the raised position.

To move the housing 34 and blade element 90 back, the knob 146 is rotated in a second direction about the axis 170 opposite the first direction. The projection 86 of the lift assembly 46 slides along the outside ramp 138 from the second end 174 to the first end 162, gradually moving the housing 34 with respect to the surface 62. In addition, the cam surface 154 of the blade assembly 50 slides along the inside ramp 142 from the second end 178 to the first end 166, but the blade assembly 50 remains in the raised position until the cam surface 154 passes the flat portion 182. (i.e., the blade element 90 remains in the retracted position until the housing 34 has been completely lowered). When the cam surface 154 has reached the first end 166 of the inside ramp 142, the arm member 110 rotates about the axis 122 under the force of springs 98, allowing the bracket 94 and blade element 90 to be lowered.

Accordingly, the distance 130 between the nozzle inlet 42 and the surface 62, and the distance 134 between the blade element 90 and the housing 34 can both be adjusted simultaneously by the user rotating a single knob 146. Various features and advantages of the invention are set forth in the following claims.

What is claimed is:

1. A surface cleaner comprising:

a housing;

an adjustable lift assembly coupled to and moveable relative to the housing;

an adjustable blade assembly coupled to and moveable relative to the housing;

a spring coupled between the housing and the adjustable blade assembly, the spring applying a force on the adjustable blade assembly to move the adjustable blade assembly toward a lowered position, wherein the adjustable blade assembly is allowed to move toward a raised position against the force such that the force maintains the adjustable blade assembly in contact with a surface to be cleaned; and an adjustment member coupled to and movable relative to the housing to adjust the adjustable lift assembly and the adjustable blade assembly;

wherein the adjustment member includes a first cam surface coupled to the adjustable lift assembly and a second cam surface coupled to the adjustable blade assembly.

2. The surface cleaner of claim 1, wherein the adjustable blade assembly translates linearly between the lowered position and the raised position relative to the housing; and wherein the adjustable blade assembly is held against the force and inhibited from moving toward the lowered position when in the raised position.

3. The surface cleaner of claim 1, wherein the adjustment member is operable to move the adjustable blade assembly between the lowered position and the raised position.

4. The surface cleaner of claim 1, wherein the adjustable blade assembly is moved against the force of the spring by the surface to be cleaned.

5. The surface cleaner of claim 1 wherein the adjustable blade assembly translates linearly between the lowered position and the raised position relative to the housing;

and wherein actuation of the adjustment member moves the adjustable blade assembly from the lowered position to the raised position.

6. The surface cleaner of claim 1, further including an arm member coupling the adjustment member to the adjustable blade assembly.

7. The surface cleaner of claim 6, wherein the arm member translates along the second cam surface as the adjustment member is actuated.

8. The surface cleaner of claim 7, wherein the adjustable blade assembly further includes a bracket supporting a blade element and the arm member is coupled to the bracket.

9. The surface cleaner of claim 8, wherein the arm member is rotatable about an axis.

10. The surface cleaner of claim 9, wherein actuation of the adjustment member rotates the arm member about the axis, the arm member holding the adjustable blade assembly against the force of the spring and inhibiting the adjustable blade assembly from moving toward the lowered position.

11. The surface cleaner of claim 1, wherein the housing includes a suction inlet formed therein and the adjustable blade assembly is positioned in a working direction behind the suction inlet.

12. The surface cleaner of claim 1, wherein the adjustment member includes a rotatable knob.

13. The surface cleaner of claim 1, wherein the adjustable blade assembly includes a blade element.

14. The surface cleaner of claim 13, wherein the blade element is elastomeric.

15. The surface cleaner of claim 13, wherein the adjustment member moves the adjustable blade assembly between the lowered position in which the blade element extends a first distance from the housing to the raised position in which the blade element extends a second distance from the housing, the second distance less than the first distance, and further wherein the adjustment member moves the adjustable lift assembly from a first position in which the housing is a third distance above a surface to be cleaned to a second position in which the housing is a fourth distance above the surface to be cleaned, the third distance less than the fourth distance.

16. The surface cleaner of claim 1, wherein the first cam surface and the second cam surface are formed as part of a rotatable knob.

17. The surface cleaner of claim 15, wherein the adjustable blade assembly is in the lowered position when the adjustable lift assembly is in the lower position.

* * * * *